US008764347B2

(12) United States Patent
Gunnarson

(10) Patent No.: US 8,764,347 B2
(45) Date of Patent: Jul. 1, 2014

(54) TELESCOPING LEADER SYSTEM

(75) Inventor: Jay Gunnarson, Grande Prairie (CA)

(73) Assignee: Northstar Energy Services Inc., Clairmont (CA)

( * ) Notice: Subject to any disclaimer, the term of this patent is extended or adjusted under 35 U.S.C. 154(b) by 241 days.

(21) Appl. No.: 13/266,872

(22) PCT Filed: May 3, 2010

(86) PCT No.: PCT/CA2010/000659

§ 371 (c)(1), (2), (4) Date: Oct. 28, 2011

(87) PCT Pub. No.: WO2010/124386

PCT Pub. Date: Nov. 4, 2010

(65) Prior Publication Data

US 2012/0051846 A1 Mar. 1, 2012

Related U.S. Application Data

(60) Provisional application No. 61/174,551, filed on May 1, 2009.

(51) Int. Cl.
*E02D 13/04* (2006.01)
*E02D 7/16* (2006.01)

(52) U.S. Cl.
USPC ..... 405/232; 173/184

(58) Field of Classification Search
USPC ..... 405/229, 231, 232, 244; 173/184, 186, 173/187, 188, 193, 42, 44
See application file for complete search history.

(56) References Cited

U.S. PATENT DOCUMENTS

| | | | | |
|---|---|---|---|---|
| 3,035,646 | A | 5/1962 | Johansson | |
| 3,463,245 | A | 8/1969 | Wataha | |
| 3,827,508 | A * | 8/1974 | MacKinnon | 173/112 |
| 3,388,317 | A | 6/1975 | Walters | |
| 5,304,015 | A * | 4/1994 | Sonomura | 405/232 |
| 5,944,452 | A * | 8/1999 | Reinert, Sr. | 405/232 |

FOREIGN PATENT DOCUMENTS

| | | |
|---|---|---|
| EP | 392 309 | 10/1990 |
| EP | 737 262 | 10/1996 |
| EP | 1 956 165 | 8/2008 |
| GB | 993 540 | 5/1965 |
| GB | 2 452 851 | 3/2009 |

* cited by examiner

*Primary Examiner* — Tara M. Pinnock
(74) *Attorney, Agent, or Firm* — Norton Rose Fulbright Canada LLP

(57) ABSTRACT

A telescoping leader system for a construction machine that includes a set of leads having a series of internal nesting segments and an extending means connecting one segment to another segment to allow for the extension of the segments one after the other to an extended position and the retraction of the segments to an internal nesting position. The telescoping leader system further includes a surface engaging member mounted within the set of leads and a pivotable mounting assembly mounted to the set of leads and adapted to adjust the position of the set of leads. A quick connecting means adapted to engage the pivotable mounting assembly is included to allow for the quick engagement and disengagement of the construction machined from the set of leads.

14 Claims, 10 Drawing Sheets

TELESCOPING LEADER SYSTEM

This application claims priority to U.S. Provisional Patent Appln. No. 61/174,551 filed on May 1, 2009.

FIELD OF THE INVENTION

This invention relates in general to leaders used for pile driving, drilling and augered pile operations and more particularly to a leader system that can telescope upwards and downwards.

BACKGROUND OF THE INVENTION

Typically leader systems are used to drive piles, drilling or augered pile operations and are mounted to various power units such as excavators, cranes, boom trucks or tracked machines. The leader system is responsible for guiding the hammer, drill or drive head so that it is in alignment with the pile or drilling operation. Depending on the construction a telescoping lead may be desirable. Telescoping leader systems can therefore telescope the leads either upwards or downwards. There ability to telescope either upwards or downwards depends on what the leader system is mounted to. When mounted to a crane or boom truck, the telescoping leads can move either up or down depending on orientation, however when mounted to an excavator the telescoping leader system would typically telescope upwards.

Traditional telescoping leader systems are cumbersome in that they telescope in a staged fashion, telescoping each segment out in front of each other in a stepped fashion so that segments are not along the same axis. This arrangement does not allow the leader system to be easily removed from the power unit and is not an appropriate configuration for a crane. Most leader systems for cranes have a fixed length and utilize extensions that allow for longer piles to be installed.

Prior art telescoping leader systems have been devised to address the noted problems. For example, U.S. Pat. No. 3,035,646 which issued May 22 1962 to Johansson discloses an improved pile driving attachment including a pile driving lead for use with a caterpillar or like tractor crane having a windlass frame preferably in the form of a turn-table or rotatable crane house which is carried by the under frame of the tractor. The invention further discloses a series of extendable or telescoping struts that may extended by a hydraulic system.

U.S. Pat. No. 3,388,317 which issued on Jun. 10, 1975 to Walters discloses a system for supplying full hydraulic power to the movable components of a positioning apparatus of a pile driver or similar apparatus. The device includes hydraulically drive truss sections that form the spotters for the invention which can both extend and retract.

Thus a telescoping leader system having the ability to be quickly mounted and removed from an excavator, crane, boom truck, that can install longer piles with less power and is compact in nature, is desirable.

SUMMARY OF THE INVENTION

An object of one aspect of the present invention is to provide an improved telescoping leader system.

In accordance with one aspect of the present invention there is provided a telescoping leader system for a construction machine that includes a set of leads having a series of internal nesting segments and an extending means connecting one segment to another segment to allow for the extension of the segments one after the other to an extended position and the retraction of the segments to an internal nesting position.

The telescoping leader system further includes a surface engaging member slidably mounted within the set of leads. In an excavator scenario, the system may further include a pivotable mounting assembly mounted to the set of leads and adapted to adjust the position of the set of leads. A quick connecting means adapted to engage the pivotable mounting assembly is included to allow for the quick engagement and disengagement of the construction machine from the set of leads.

Conveniently, the telescoping leader system will function with a variety of power units namely a crane, excavator, boom truck or tracked machine. The length of pile can vary dramatically and the lead system does not have to be changed as the telescoping leader system can be extended or retracted to accommodate the piles.

Preferably, the connecting means may be further defined as a hydraulic system that allows for the extension and contraction of the segments. The surface engaging member may be any type of hammer, drill or digger driver for installing augered piles.

Advantages of the present invention are telescoping leader system can retract internally for shipping purposes, may have a quick change mounting assembly for an excavator platform, allows for longer piles to be installed while requiring less energy, versatility of installing different length piles using the same system, may be mounted on a crane, able to retract for ease of movement around the construction site.

BRIEF DESCRIPTION OF THE DRAWINGS

A detailed description of the preferred embodiment is provided herein below by way of example only and with reference to the following drawings, in which.

Figure 1:
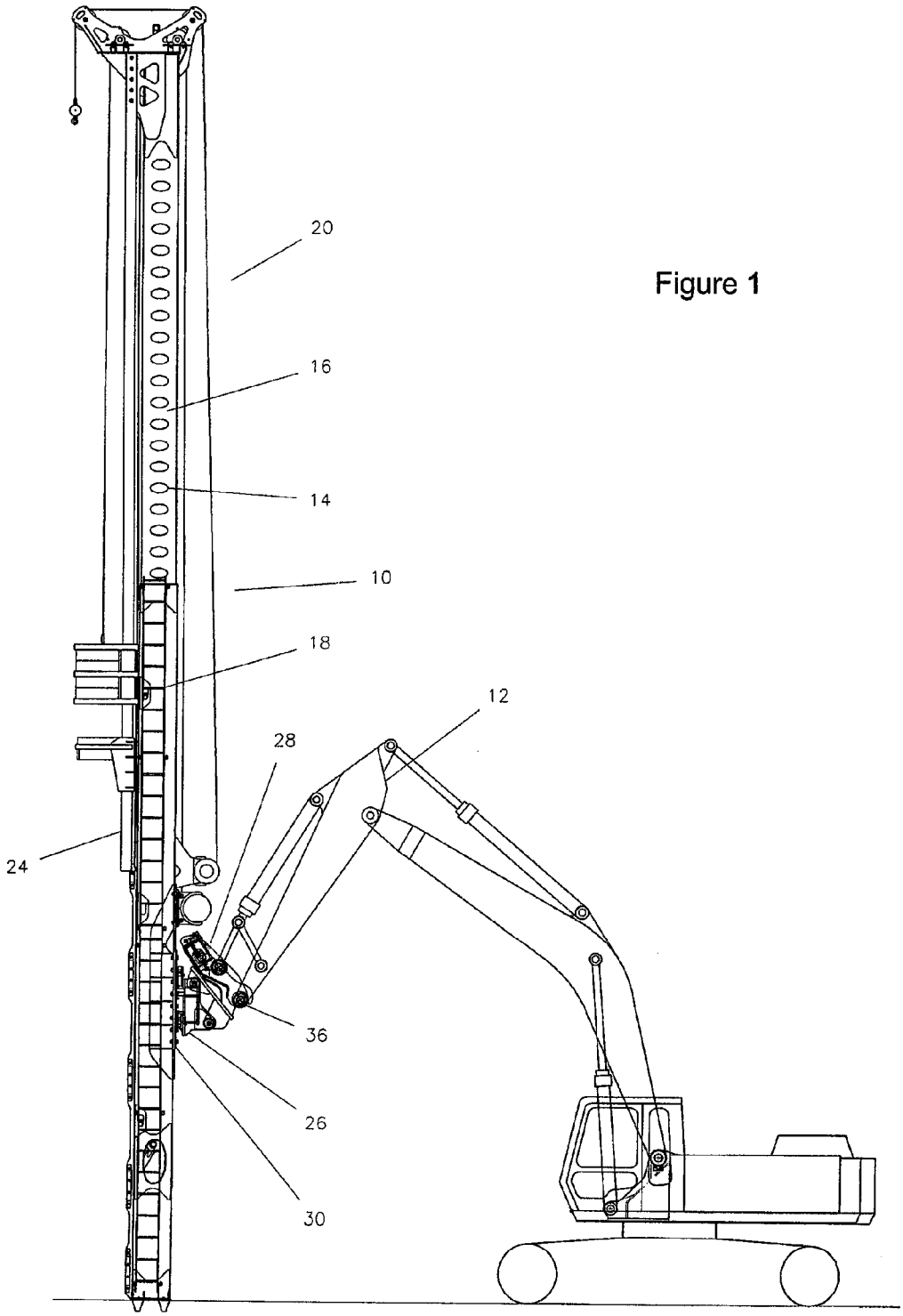
FIG. 1 in a side view, illustrates a telescoping leader system mounted on an excavator in an extended position in accordance with a preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
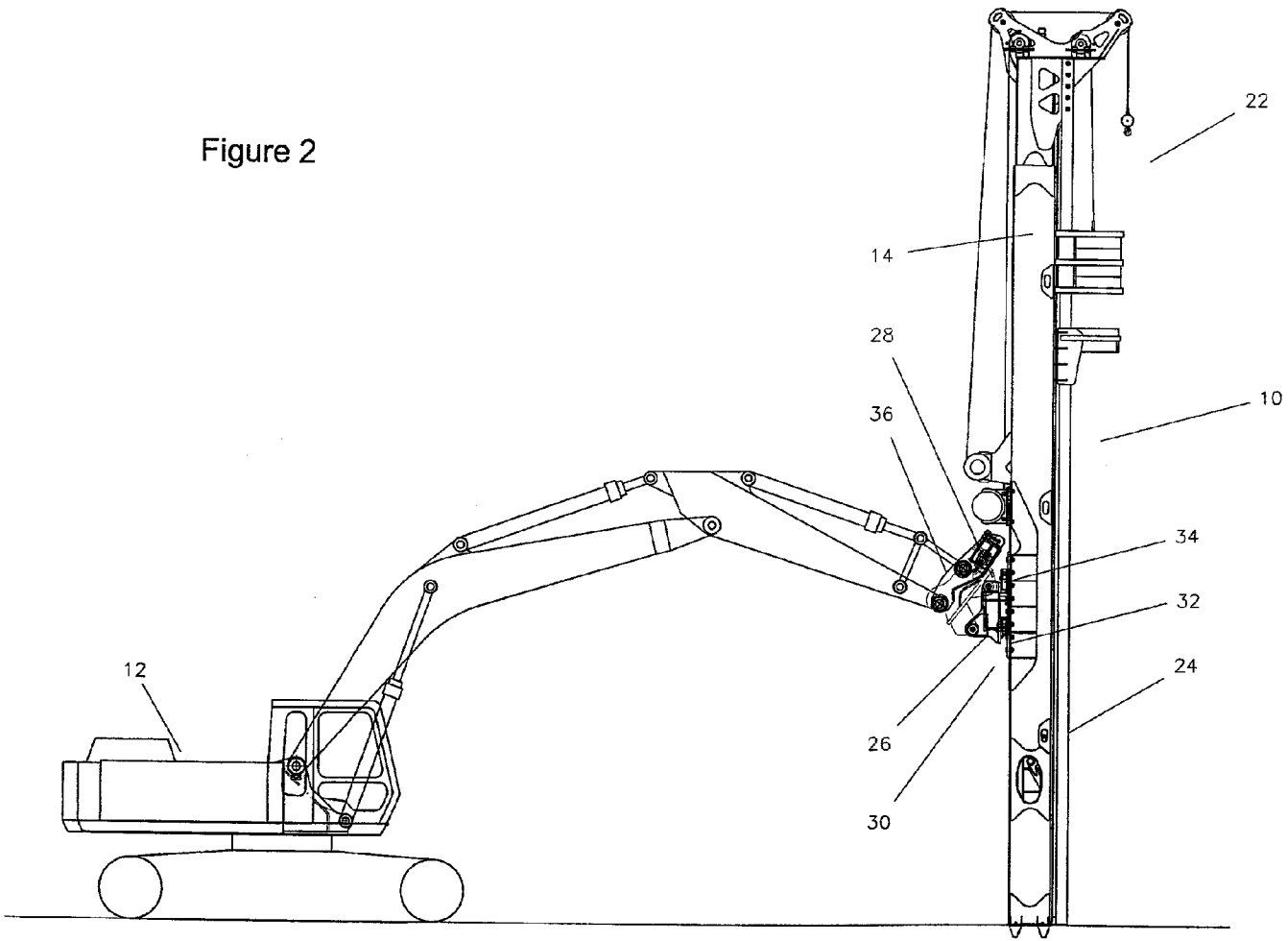
FIG. 2 in a side view, illustrates the telescoping leader system of FIG. 1 in a retracted position.
Figure 3:
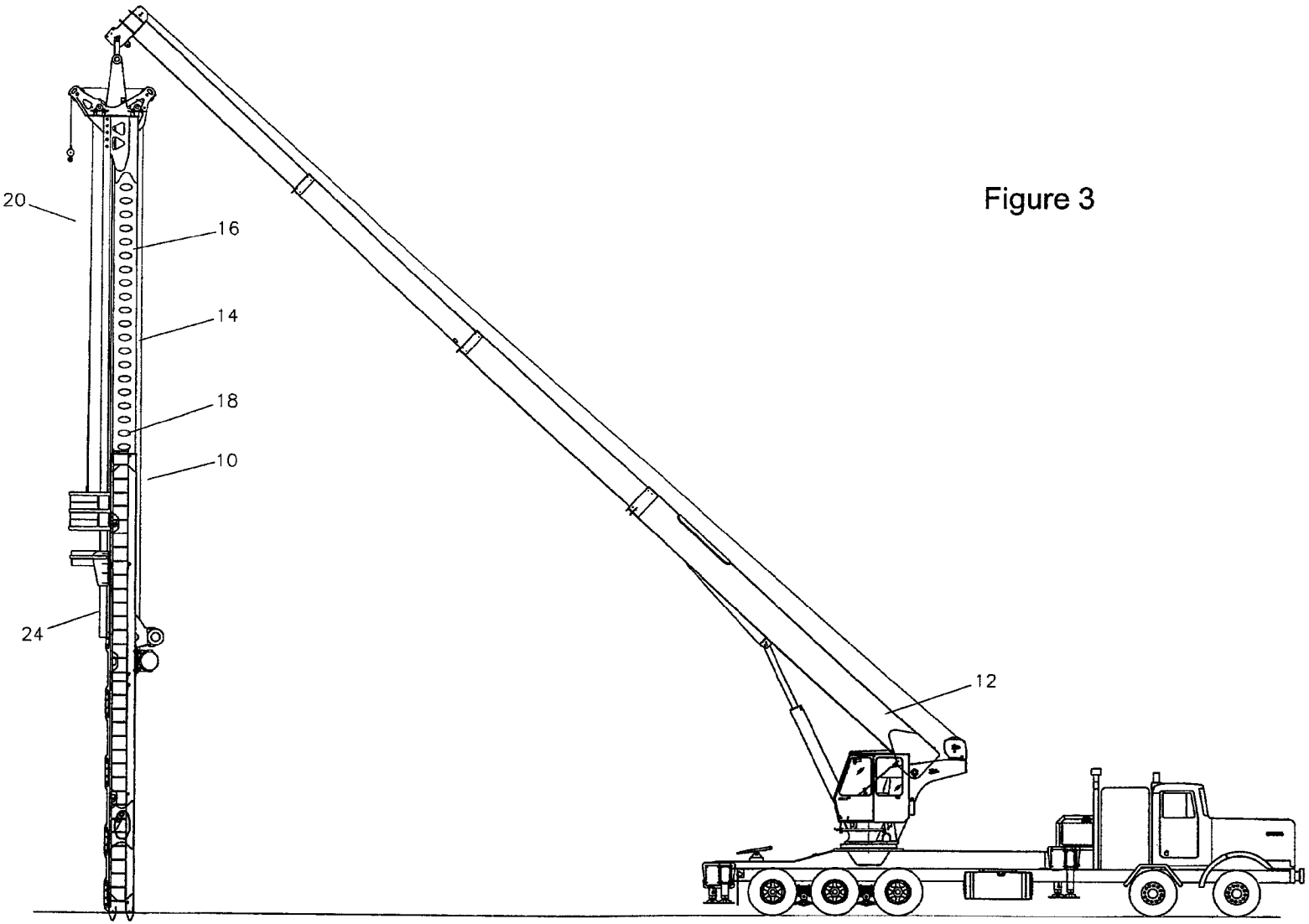
FIG. 3 in a side view illustrates the telescoping leader system mounted on a crane in an extended position in accordance with a preferred embodiment of the present invention.
Figure 4:
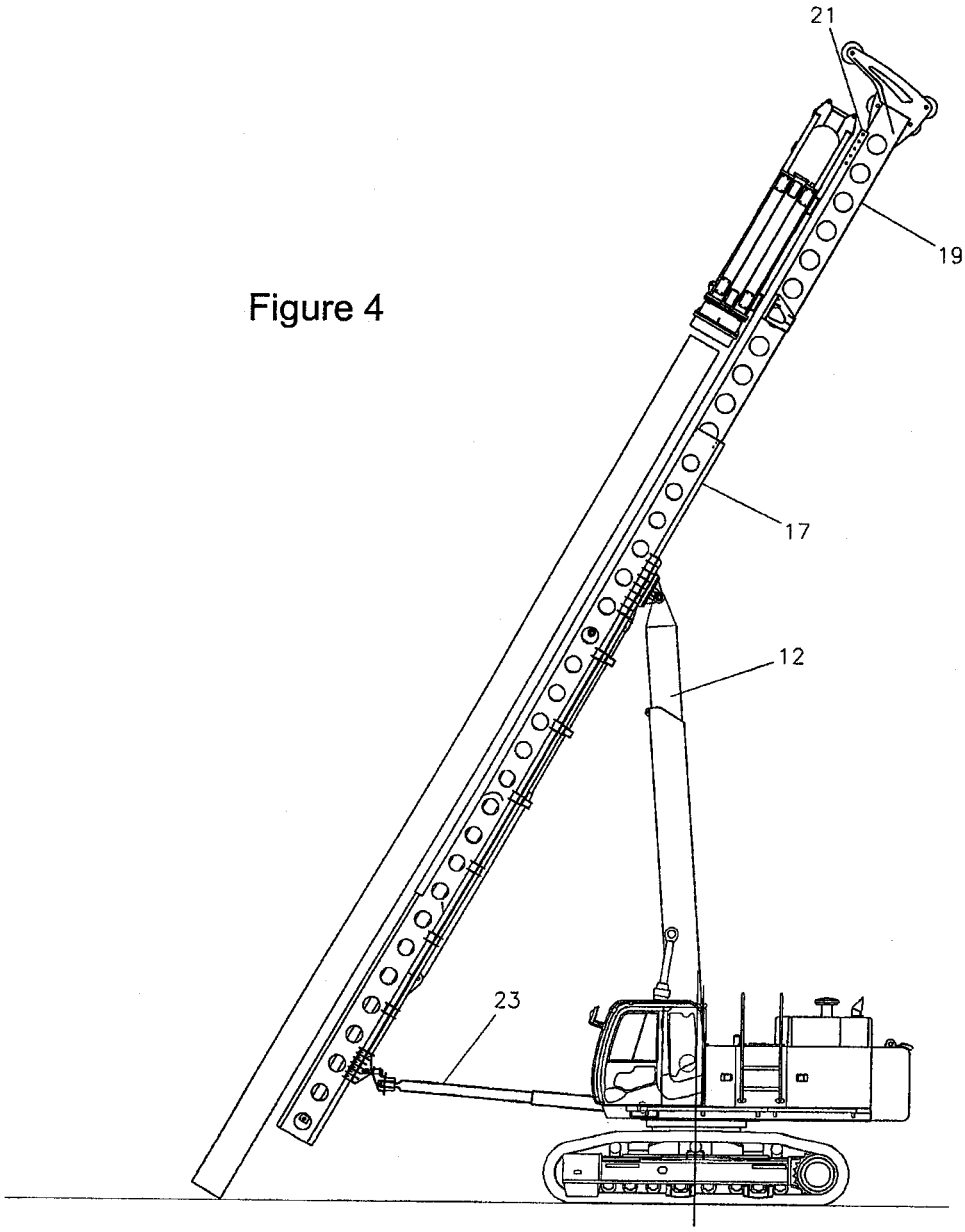
FIG. 4 in a side view, illustrates the telescoping leader system of FIG. 1 in an extended position driving a pile on a 30°.
Figure 5:
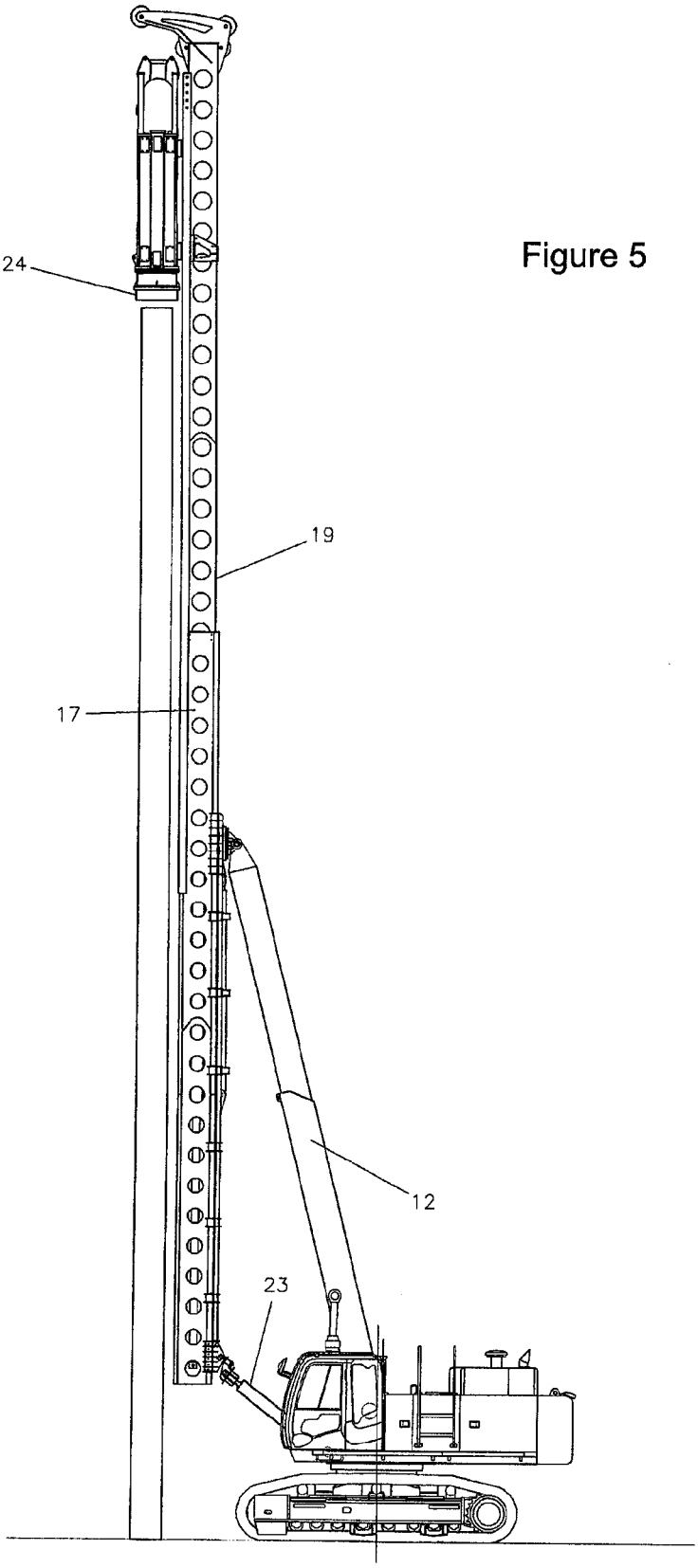
FIG. 5 in a side view, illustrates the telescoping leader system of FIG. 1 in an extended position driving a pile.
Figure 6:
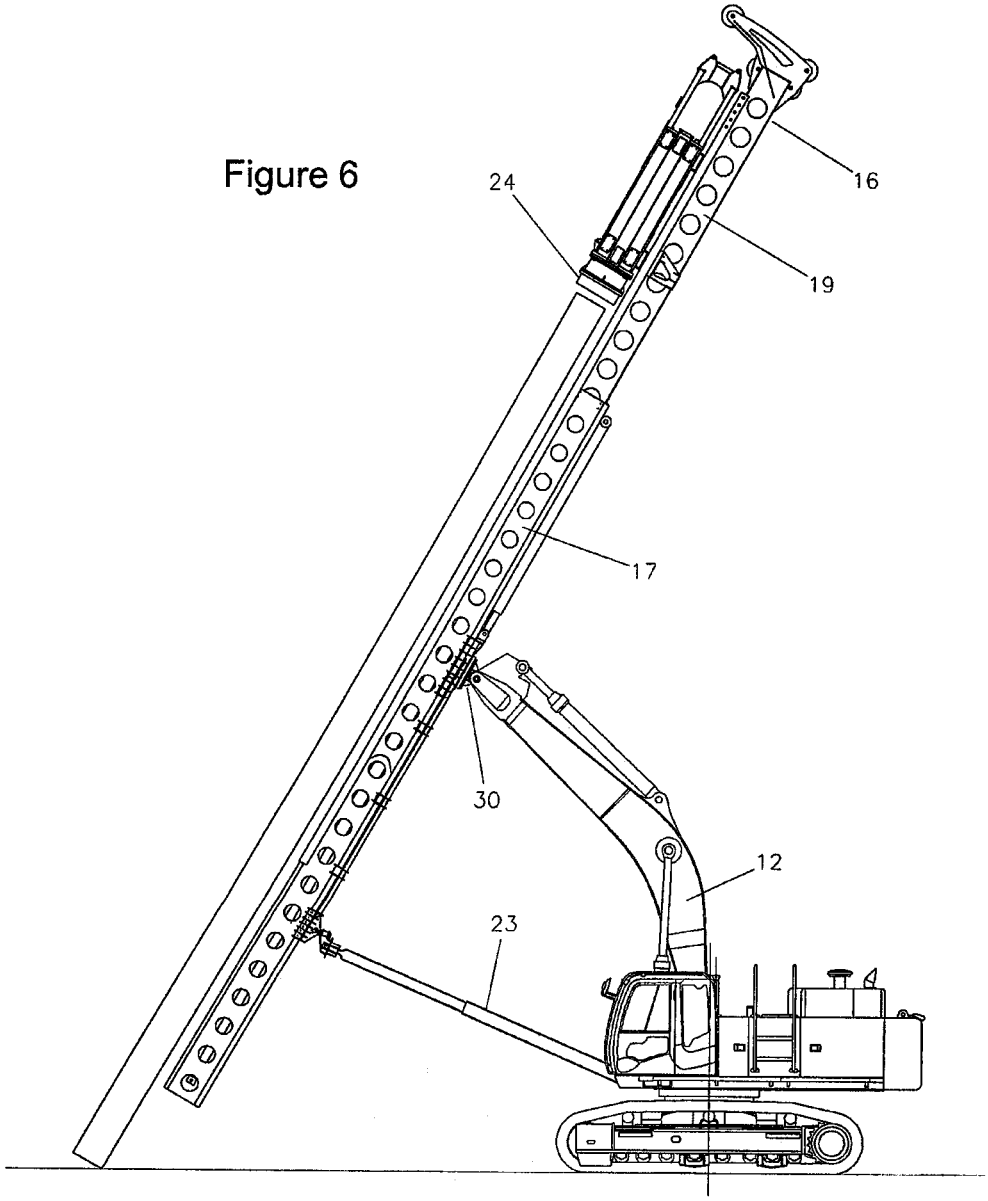
FIG. 6 in a side view, illustrates the telescoping leader system of FIG. 1 in an extended position driving a pile on a 30°.
Figure 7:
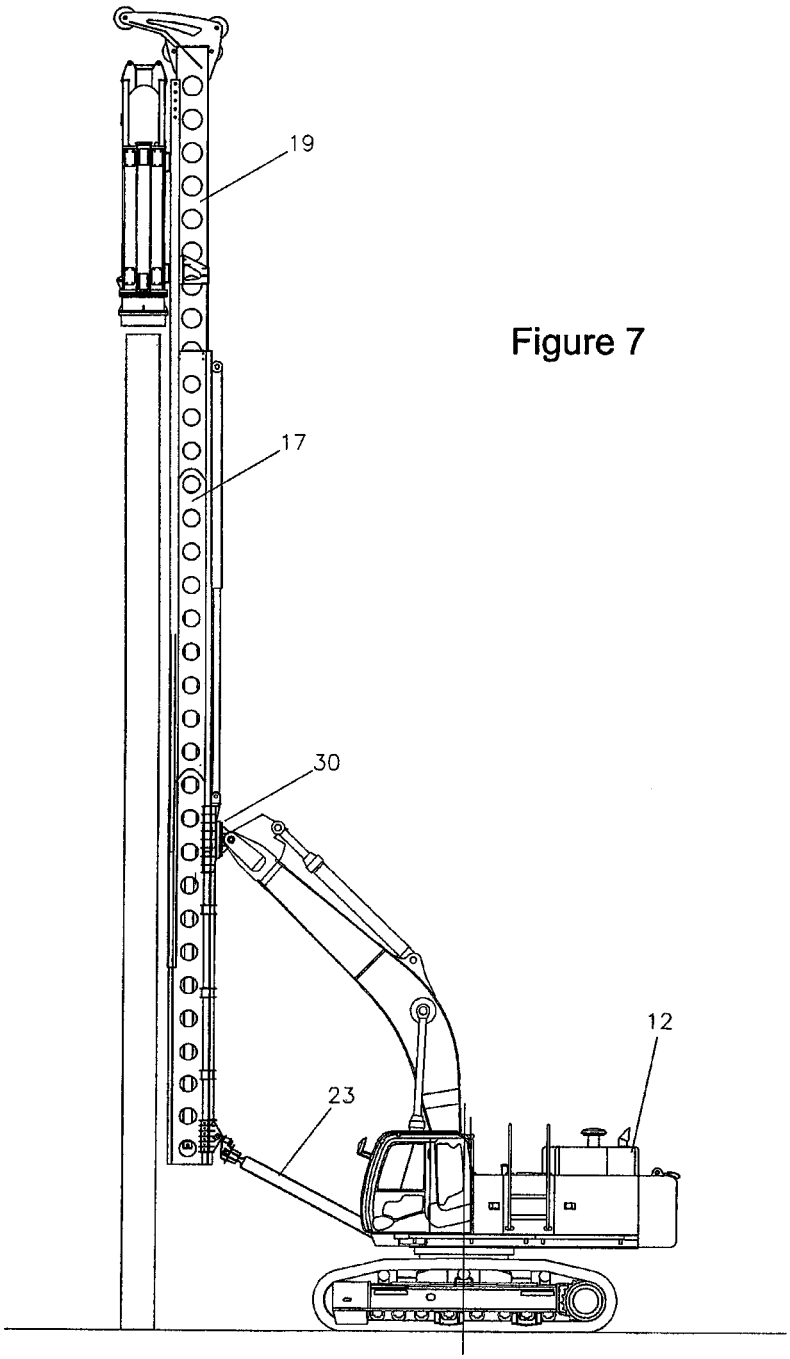
FIG. 7 in a side view, illustrates the telescoping leader system of FIG. 1 in a in an extended position driving a pile.
Figure 8:
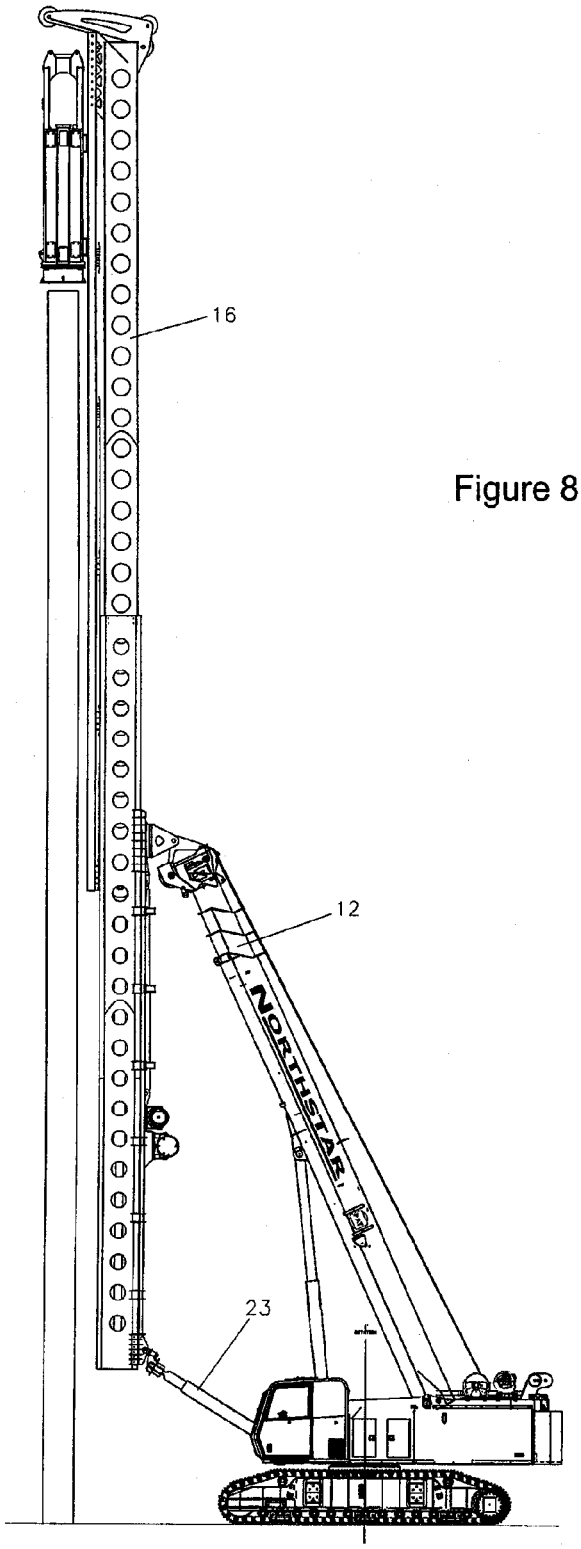
FIG. 8 in a side view, illustrates the telescoping leader system of FIG. 1 in an extended position driving a pile.
Figure 9:
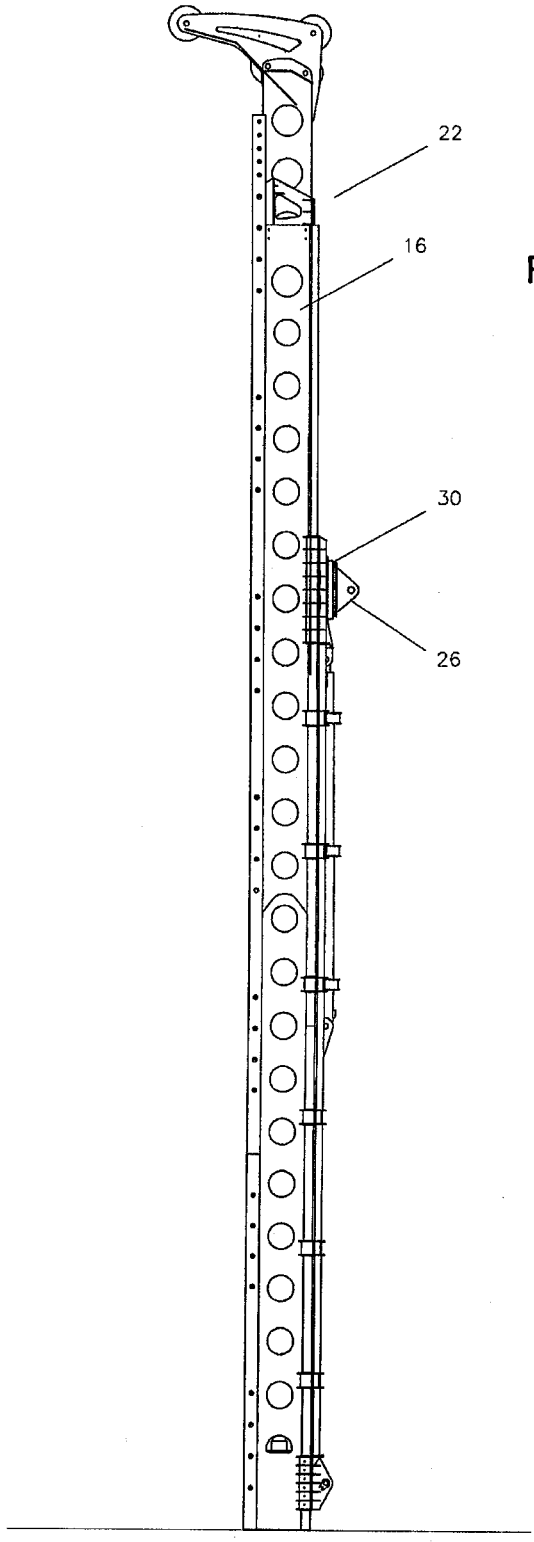
FIG. 9 in a side view, illustrates the telescoping leader system of FIG. 1 in a retracted position.
Figure 10:
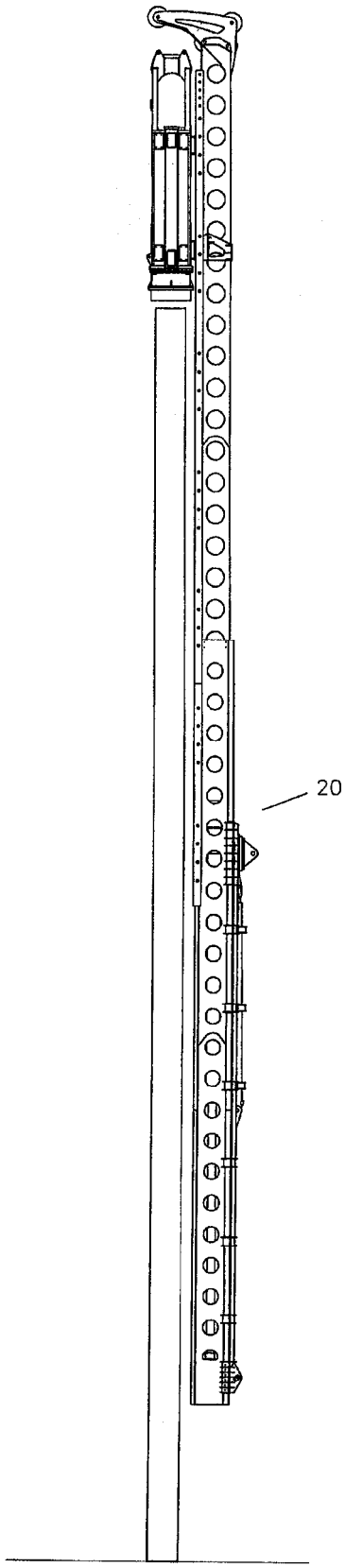
FIG. 10 in a side view, illustrates the telescoping leader system of FIG. 1 in an extended position.

Referring to FIGS. 1 to 10, there is illustrated in side views, a telescoping leader system 10 for a construction machine 12 in accordance with the preferred embodiment of the present invention. The telescoping leader system 10 for a construction machine 12 having a power unit includes a set of leads 14 having a series of internal nesting segments 16. The set of leads 14 further includes an extending means 18 that connect one segment to another segment along a single axis. The extending means 18 allows for the extension of the segments 16 one after the other to an extended position 20 and the retraction of the segments 16 to an internal nesting position 22.

The telescoping leader system 10 further includes a surface engaging member 24 slidably mounted within the set of leads 14 and a pivotable mounting assembly 26 mounted to the set of leads 14 and adapted to adjust the position of the set of leads 14. When installed in an excavator, the telescoping leader system 10 further includes a quick connecting means 28 adapted to engage the pivotable mounting assembly 26 to allow for the quick engagement and disengagement of the construction machine 12 from the set of leads 14.

The series of internal nesting segments 16 which make up the set of leads 14 can be extended to a variety of lengths depending on the desired length of pile that is to be installed. Typically the series of internal nesting segments 16 may comprise of a series of outer segments 17 and a series inner segments 19 that connect to one another so that they can telescope out to a desired length so that each of the internal nesting segments 16 always extend and retract along the same axis. Since the internal nesting segments 16 always travel along the same axis in front of each other, they do not extend in a stepped fashion like typical telescoping leads. With typical leader system the extension of the segments in a stepped fashion results in the hammer or surface engaging member 24 being farther away from the base unit. This increased distance results in increased instability of the overall structure and the requirement of a larger power unit. In the instant invention, the internal nesting segments 16 results in the pile load and leader system 10 to be kept close to the construction machine 12 which improves stability and allows for a smaller power unit.

Traditionally if a longer pile is to be installed, a longer fixed length leader segment would have to be installed to accommodate the pile. Typically the addition of this longer fixed length of leader segment would require additional or a larger power unit. In the instant invention, the internally nesting segments 16 can be extended or retracted using the same small power unit. The instant invention is also capable of installing augered piles with a top drive auger mounted in the set of leads 14.

In the internal nesting position 22, the telescoping leader system 10 becomes a compact unit that allows for easy shipping to new construction sites, as well as moving to various projects while on a construction site. Furthermore in the internal nesting position 22 the operator is afforded greater control over the telescoping leader system 10 and therefore greater safety when moving around the construction site. Therefore one benefit for the me compact unit is the mobility of the system and the ability to retract the system to a lower height when desired, and therefore have the ability to install various length piling with one system as the length of the system can be easily changed. Typically leader systems are fixed in length and would be set to a predetermined length for a project and would have to be modified during a project if required.

Typical the telescoping leader system 10 may be used with a variety of construction machines 12 namely an excavator, crane or tracked machine. Conveniently the telescoping leader system 10 may be mounted to the front stick or boom of the excavator, or it may be mounted to a hydraulic boom crane or lattice boom crane. With a crane or picker truck the telescoping leader system 10 would be attached to the tip of the power unit or it could be suspended from winch associated with the power unit. The type of construction machine 12 associated with the telescoping leader system 10 will dictate what lifting mechanisms such as winches or hoisting devices are installed on the telescoping leader system 10. With an excavator, hoisting devices would be installed actually on the telescoping leader system 10 and with a crane/picker truck the hoisting devices could be installed on either the telescoping leader system 10 or off of the power unit itself. Typically an excavator can install piles up to 60 feet long with the instant invention.

More specifically the telescoping leader system 10 may be mounted to a rubber tire crane that has traditionally not been used for pile driving. The rubber tire crane is able to move around work sites as the crane is mounted on tires. For this type of crane to move around a construction site with a fixed length leader system, the boom of the crane would have to be extended to accommodate the length of the fixed leader. With the boom extended, the rubber tire crane can not move as the load capacity would exceed that of tires so as to be able to move. With the instant invention the boom length of the rubber tire crane and the set of leads 14 would be retracted to the shortest position or the internal nesting position 22 and therefore would be within the design capacity for the power unit of the rubber tire crane so as to be able move around on its tires. Most construction sites have rubber tire cranes on site and with the installation of the telescoping leader system 10, a rubber tire crane that is typically not used would become quite functional.

The extending means 18 may be further defined as a hydraulic system that connects the internal nesting segments 16 to one another and allows them to move in between the extended position 20 and the internal nesting position 22. The hydraulic system may be further defined as a combination of hydraulic cylinders with locking pins and/or a cable system in tandem with the lead system 10 by way of example only. For example an external cylinder can provide vertical movement of the leader system 10 from 2 meters to 6 meters. Furthermore the extending means 18 further includes a guiding system 21 that connects the outer segments 17 to the inner segments 19 so as to provide a continuous surface for the surface engaging member 24 to travel the length of the leads 14 in either the extended position 20 or internal nesting position 22.

The surface engaging member 24 slidably mounted to the leads 14 may be further defined as a hammer slidably mounted to the set of leads and specifically via the guiding system 21 so as to allow for continuous driving face for the telescoping leader system 10. Furthermore the positioning of the guiding system 21 requires less operational movement of the leader system 10. Various types of hammers may be used, including but not limited to gravity, diesel or hydraulic.

When being used with an excavator, the pivotable mounting assembly 26 is mounted to the set of leads 14 and is adapted to adjust the position of the telescoping leader system 10. Typically the pivotable mounting assembly 26 may be secured to the set of leads 14 at a point within an attachment zone 30. The attachment zone 30 is defined as an area on the set of leads 14 that allows for the correct positioning of the set of leads 14 relative the construction machine 12. The pivotable mounting assembly 26 includes mounting head 32 that has a pivoting mechanism 34 that allows for the pivot of the set of leads 14 up to a maximum 20° left or right on a vertical plane.

The ability to pivot the set of leads 14 allows for the adjustment and alignment of the set of leads 14 according to the operators needs. Furthermore this adjustment does not involve any movement of the front stick or boom of the excavator 12.

The quick connecting means 28 is adapted to engage both the pivotable mounting assembly 26 and the front stick or boom of the construction machine 12. The quick connecting means 28 may be further defined as a quick change adapter 36 that is mounted to the mounting head 32. The quick change adapter 36 therefore allows the pivotable mounting assembly 26 and therefore the set of leads 14 to be quickly mounted to the front stick or boom of the construction machine 12. As such the excavator 16 can be converted from its traditional use, to its use with the telescoping leader system 10 within one hour.

The telescoping leader system 10 may further include a connection point for a telescoping foot, spotter or kicker 23 to ensure the set of leads 14 are always stable. The spotter 23 may be required for specific types of power unit installations as seen in FIGS. 4 to 8. Specifically the set of leaders are mounted to the power unit part way up, and the spotter provides stability at the base of the set of leads so as to better position the telescoping leader system 10. As noted above lifting devices or hoisting devices such as winches may be mounted directly to the set of leads 14 so as to lift the hammer and the pile line for positioning the pile itself.

In operation the telescoping leader system 10 the operator of the construction machine 12 has the option of extending or retracting the telescoping leader system 10 as desired. If only a few piles require the extended length, the operator can choose the internal nesting position 22 or retracted position for operating after the longer piles are completely installed. Current lead configuration do not allow this and the operator would be required to work at the extended height or would have to stop piling operations and remove a section from the fixed leader. As noted above the telescoping leader system 10 may be used with a crane, picker truck or excavator, or for any piling unit that requires a leader.

The telescoping leader system 10 can then telescope upwards or can telescope downwards depending on the type of power unit the telescoping leader system 10 is mounted to. For an excavator mount, the telescoping leader system 10 would telescope upwards and for crane/picker mount the telescoping leader system 10 could telescope either way.

Other variations and modifications of the invention are possible. All such modifications or variations are believed to be within the sphere and scope of the invention as defined by the claims appended hereto.

I claim:

1. A telescoping leader system for a construction machine having a power unit comprising:

(a) a set of leads having a series of internal nesting segments whereby the set of leads can move up and down;

(b) an extending means connecting one segment to another segment to allow for the extension of the segments one after the other along a single axis to an extended position and the retraction of the segments to an internal nesting position;

(c) a surface engaging member slidably mounted within the set of leads for engagement of a pile;

(d) a pivotable mounting assembly mounted to the set of leads and adapted to adjust the position of the set of leads; and (e) a connecting means adapted to directly engage the pivotable mounting assembly and the construction machine to allow for the quick engagement and disengagement of the construction machine from the set of leads;

wherein the power unit directly activates the poivotable mounting assembly via the connecting means whereby the pivotabie mounting assembly moves the set of leads.

2. A telescoping leader system for a construction machine having a power unit as claimed in claim 1 wherein the series of internal nesting segments are a series of outer segments and a series inner segments that connect to one another and telescope out to a desired length along the same axis.

3. A telescoping leader system for a construction machine having a power unit claimed in claim 2 wherein the extending means is a hydraulic system that connects the inner and outer segments to one another and allows them to move in between the extended position and the internal nesting position.

4. A telescoping leader system for a construction machine having a power unit as claimed in claim 3 wherein the hydraulic system is a combination of hydraulic cylinders with locking pins and/or a cable system in tandem with the lead system.

5. A telescoping leader system for a construction machine having a power unit as claimed in claim 3 wherein the extending means further includes a guiding system that connects the outer segments to the inner segments to provide a continuous surface for the surface engaging member to travel.

6. A telescoping leader system for a construction machine having a power unit as claimed in claim 5 wherein the surface engaging member is a hammer slidably mounted to the set of leads and the guiding system so as to allow for continuous driving face for the telescoping leader system.

7. A telescoping leader system for a construction machine having a power unit as claimed in claim 6 wherein the hammers is selected from a group consisting of gravity, diesel or hydraulic.

8. A telescoping leader system for a construction machine having a power unit as claimed in claim 5 wherein the pivotable mounting assembly is secured to the set of leads at a point within an attachment zone.

9. A telescoping leader system for a construction machine having a power unit as claimed in claim 8 wherein the attachment zone is an area on the set of leads that allows for the correct positioning of the set of leads relative the construction machine.

10. A telescoping leader system for a construction machine having a power unit as claimed in claim 9 wherein the pivotabie mounting assembly is mounting head that has a pivoting mechanism for the pivot of the set of leads up to maximum 20° or right on a vertical plane.

11. A telescoping leader system for a construction machine having a power unit as claimed in claim 10 wherein the connecting means is a quick change adapter mounted to the mounting head.

12. A telescoping leader system for a construction machine having a power unit as claimed in claim 11 wherein the set of leads further comprises a connection point for a telescoping foot for contact with the ground and provide stability.

13. A telescoping leader system for a construction machine having a power unit as claimed in claim 9 wherein the set of leads further comprises lifting devices mounted directly to the set of leads to lift a hammer.

14. A telescoping leader system for a construction machine having power unit as claimed in claim 9 wherein the construction machine is selected from a group consisting of an excavator, crane or tracked machine.

* * * * *